US005508590A

United States Patent [19]

Sampayan et al.

[11] Patent Number: 5,508,590

[45] Date of Patent: Apr. 16, 1996

[54] FLAT PANEL FERROELECTRIC ELECTRON EMISSION DISPLAY SYSTEM

[75] Inventors: Stephen E. Sampayan, Manteca; William J. Orvis, Livermore; George J. Caporaso, Livermore; Ted F. Wieskamp, Livermore, all of Calif.

[73] Assignee: The Regents of the University of California, Oakland, Calif.

[21] Appl. No.: 330,882

[22] Filed: Oct. 28, 1994

[51] Int. Cl.[6] ..... H01J 29/70

[52] U.S. Cl. ..... 315/169.1; 313/422; 313/326; 313/346 R; 313/458

[58] Field of Search ..... 315/169.1, 169.4, 315/169.3, 326; 313/422, 326, 329, 346 R, 364, 458

[56] References Cited

U.S. PATENT DOCUMENTS 3,840,748 10/1974 Braunlich ..... 250/423
5,126,638 6/1992 Dethlefsen ..... 315/326
5,132,826 7/1992 Johnson et al. ..... 359/93

OTHER PUBLICATIONS

Sampayan et al., Nuclear Instruments & Methods In Physics Research, "Emisson from ferroelectric cathodes", Feb. 11, 1994. pp. 90-95.

*Primary Examiner*—Robert J. Pascal
*Assistant Examiner*—Michael B. Shingleton
*Attorney, Agent, or Firm*—Henry P. Sartorio; John W. Wooldridge

[57] ABSTRACT

A device which can produce a bright, raster scanned or non-raster scanned image from a flat panel. Unlike many flat panel technologies, this device does not require ambient light or auxiliary illumination for viewing the image. Rather, this device relies on electrons emitted from a ferroelectric emitter impinging on a phosphor. This device takes advantage of a new electron emitter technology which emits electrons with significant kinetic energy and beam current density.

28 Claims, 5 Drawing Sheets

FLAT PANEL FERROELECTRIC ELECTRON EMISSION DISPLAY SYSTEM

The United States Government has rights in this invention pursuant to Contract No. W-7405-ENG-48 between the United States Department of Energy and the University of California for the operation of Lawrence Livermore National Laboratory.

BACKGROUND OF THE INVENTION

1. Field of the Invention

The present invention relates to flat panel display systems, and more specifically, to a flat panel ferroelectric display system.

2. Description of Related Art

Ferroelectrics have the unique property of spontaneous polarization along a polarization axis. The material remains neutral internally as the end of each dipole is paired with the opposite end of the next dipole along that polar axis. At any boundary with a normal component to this axis, the dipoles are unpaired and a material dependent bound charge will exist. As a consequence of this abnormally high energy state, free screening charges collect to neutralize the surface. It is possible to eject a pulse of these charges and/or induce a field emission pulse by altering the material's internal polarization.

Experimental evidence of weak electron emission from a ferroelectric material was found as early as 1964. The popular view of the process is that ferroelectric emission results from the expulsion of the free screening charge from the material's surface upon a rapidly induced change of the internal polarization. Another possibility is that ferroelectric emission is actually a field emission process where an extremely large electric field, generated by the spontaneous bound charge, is caused to exist across a nonferroelectric layer on the surface.

The renewed interest in ferroelectric emission is attributed to the development of better emitter materials. Ceramics such as Lead-Titanate-Zirconate (PZT) or Lead-Lanthanum-Titanate-Zirconate (PLZT) can be switched very rapidly (10's of nanoseconds) compared to any characteristic diffusion or relaxation times. Further, these new materials can have an extremely high spontaneous bound charge (up to 100 $\mu C./cm^2$). Thus upon polarization inversion, strong emission occurs (>100 $A/cm^2$).

SUMMARY OF THE INVENTION

It is an object of the present invention to provide an emissive flat panel ferroelectric display system.

The invention provides a bright, raster scanned or non-raster scanned image from a flat panel. Unlike many fiat panel technologies, this device does not require ambient light or auxiliary illumination for viewing the image. Rather, this device relies on electrons emitted from a ferroelectric emitter impinging on a phosphor. This device takes advantage of a new electron emitter technology which has been shown to emit electrons with significant kinetic energy and beam current density.

DETAILED DESCRIPTION OF THE INVENTION

Under the proper conditions, ferroelectric materials can be induced to intensely emit electrons (on the order of 100 $A/cm^2$). The mechanism is believed to be either field emission resulting from the intense electric field generated at the surface of the ferroelectric during a rapid polarization change or ejection of the free screening charge. The most unique property of the material is that the emitted electrons are ejected at a significant energy (on the order of 10's of keV). This unique property evidences itself by both direct measurement and emission current densities above the Child-Langmuir space charge limit for electrons accelerated across an anode-cathode gap.

As the intensity of light emitted from a phosphor is strongly dependent on the incident electron current and energy, an array of ferroelectric emitters opposite a phosphor can be made into a bright, emissive, flat panel display device.

The primary advantage of this device over present technology is that significantly higher brightness displays can be built. Much of today's flat panel display technology relies on either ambient or auxiliary lighting built into the display. This new device generates the required image intensity based on the electron energy emitted from the ferroelectric. The most significant use of the technology would be in avionics display systems where bright displays are required. Other applications would include flat panel TV screens and computer display devices.

Figure 1:
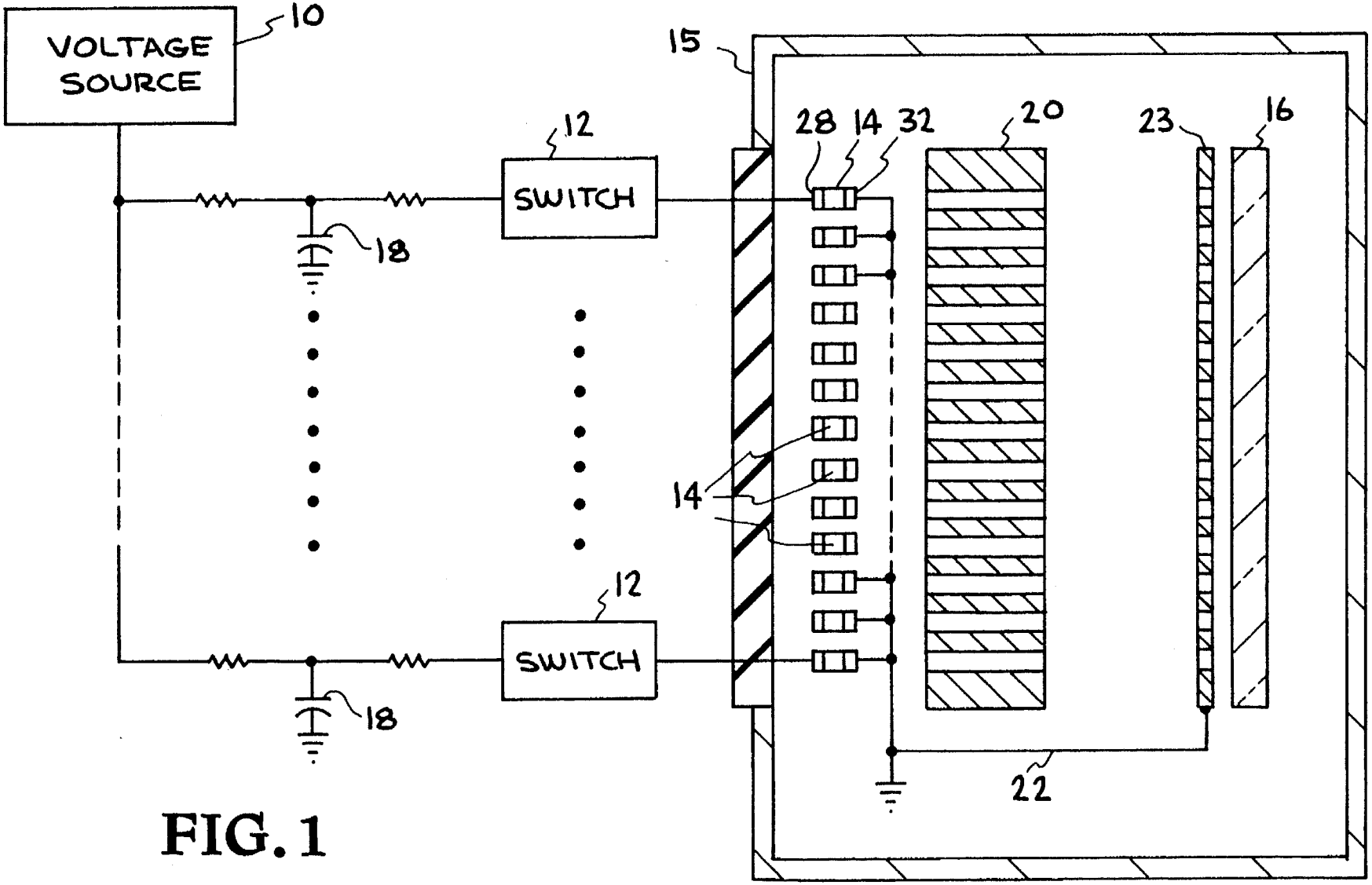
FIG. 1 shows a flat panel ferroelectric display system.
Figure 4:
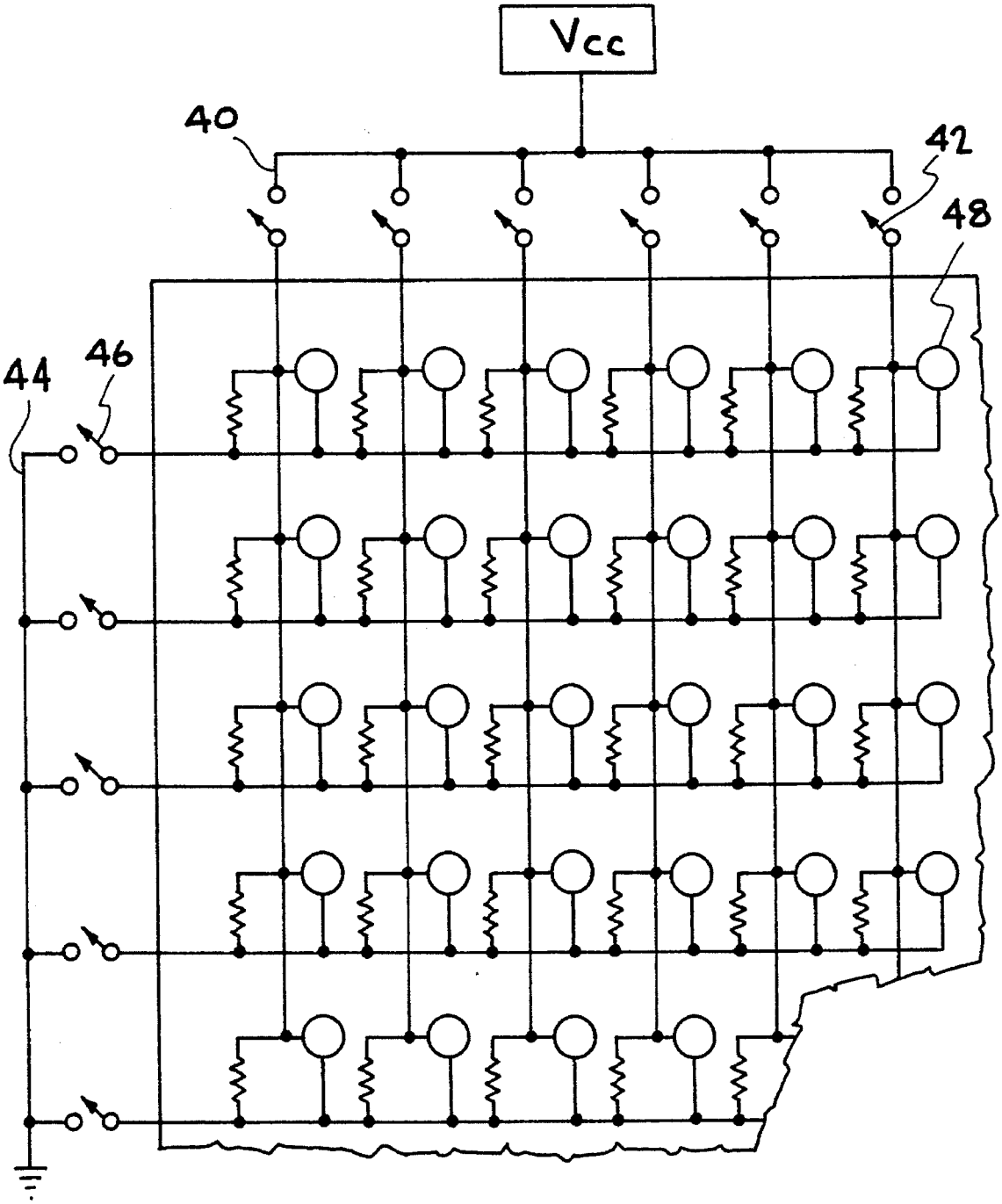
FIG. 4 shows row/column switching.

FIG. 1 shows a flat panel, emissive display device which uses ferroelectric electron emission to excite a phosphor screen. The device comprises a voltage source 10, at least one switch 12, at least one ferroelectric emitter 14 having an input electrode 28 and an output electrode 32, an evacuated enclosure 15 and a phosphor coated screen 16. The screen may comprise a two-dimensional matrix of red-green-blue phosphors for color display or a single phosphor color for single color display. The device may include at least one voltage storage means 18 comprising a capacitor or an inductor. Switch 12 may comprise a row/column switch as shown in FIG. 4. Ferroelectric emitter 14 may include a two-dimensional row/column ferroelectric emitter array. A beam collimator 20 may be inserted between ferroelectric emitter 14 and phosphor coated screen 16.

A return current means 22 comprising grid 23 may be located between the ferroelectric emitter 14 and the phosphor coated screen 16. Grid 23 may also function to forwardly reflect backscattered light. Electrons emitted from a ferroelectric emitter, resulting from a polarization change, impinge on a phosphor to generate an image by proper addressing of the row/column switching matrix. By inserting grid 23 between the exit electrode and the phosphor, with a return current means comprising a high voltage power supply, a potential relative to the ferroelectric emitter can be defined on the grid 23 to control overall pixel intensity by regulating the electron intensity (generally, i.e., energy will vary also) with that potential.

Figure 3:
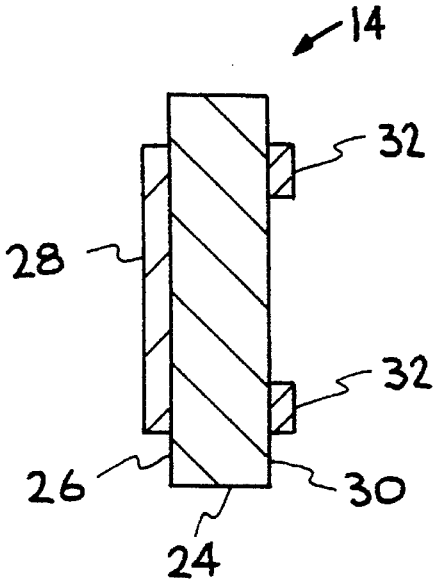
FIG. 3 shows a ferroelectric crystal with input and output electrodes.

Referring to FIG. 3, ferroelectric emitter 14 comprises ferroelectric material 24, which may be a ferroelectric crystal, and has an input face 26 with an input electrode 28. Ferroelectric material 28 has an output face 30 with output electrodes 32 (exit electrodes) which may be grounded or referenced common to voltage source 10. The input electrode 28 and output electrodes 30 may comprise wire sheets or evaporated metal attached to the material 24.

FIG. 4 shows a row/column switch. This switch has columns 40 with switches 42 and rows 44 with switches 46. A ferroelectric emitter 48, for example, may be switched to its voltage source by the use of a single switch for every row of electron emitters and a single switch for every column of electron emitters. In the control scheme shown, an entire row of emitters are turned off simultaneously. The row to be turned on is selected by closing the ground path for that row. This allows the entire row of emitters to be turned on. The electron emission is then controlled by the appropriate column switch. Resistors are placed between the two conductive surfaces on the ferroelectric. This allows the charge on the capacitance of the ferroelectric to drain between times when that row is driven. This switching mechanism allows several methods of electron modulation including pulse width, amplitude and pulse number.

One embodiment of the invention provides significant improvement over present field emitter technology. For instance, in the more classical and first embodiment of the invention, the return current means can include a high voltage power supply which gives energy to the electrons prior to impinging onto the phosphor. In this case, the improvement over existing technology is a ferroelectric, gated cathode which does not require a complex, highly sharpened structure to field emit a pulse of electrons on command.

Ferroelectrics can also emit electrons with significant kinetic energy. Significant improvement can therefore result from this unique property. In one embodiment, the return current means can simply be a conductor. The energy gained by the emitted electrons will then be defined by the uncompensated charge on the ferroelectric surface. In this embodiment, added improvements are required to control the energy of the emitted electrons. To optimize a given display system, it is necessary to adjust the emitted electron energy for a given phosphor. In an emissive ferroelectric display, this energy can be influenced by modifying various geometric parameters.

Electrons emitted from a ferroelectric surface are believed to derive their energy from the electric field developed by the interaction of the uncompensated charge developed on the surface and the system geometry. In the display system described, the resultant uncompensated surface charge density can be dependent on the driving pulse, material type, initial polarization state of the material, etc. These parameters are difficult to control independently. Thus, for display purposes, to easily modify the electric field resulting from the uncompensated charge and therefore the electron energy, one must resort to modifying the system geometry.

The technique has not been applied to, nor is it obvious in, a display system of this type. The technique has been partially applied to X-ray tubes which used a change in temperature to induce a polarization change likewise stimulating electron emission. Unlike the emitter described here, however, the ferroelectric did not utilize a grid on its surface to control the emission process.

The energy of the emitted electrons can be modified by changing the geometry both longitudinally and transversely. The effect of changing the emitted electron energy by modifying the ferroelectric display system geometry in the longitudinal direction is as follows.

In an electrode system consisting of a first grounded electrode, a ferroelectric material, a vacuum gap, and a collector, it is observed that as the collector electrode is moved closer to the emitter surface, the energy of the emitted electrons decreases (in the case of the display system, this electrode would be the return current screen in the vicinity of the phosphor).

The explanation behind this effect is as follows. A capacitance is formed between the ferroelectric surface, the collector electrode, and the first grounded electrode. The value of this capacitance, for a given material, is inversely proportional to the spacing between the first grounded electrode and the ferroelectric emitter surface plus the capacitance between the ferroelectric surface and the collector electrode.

Prior to an induced change in the ferroelectric polarization, screening charge neutralizes the bound charge just below the ferroelectric surface. As a result, no potential difference exists and the electric field between the ferroelectric and the collector is zero. When a sudden change is induced in the ferroelectric polarization, charge is suddenly exposed on the surface of the ferroelectric. This charge will now define an electric field proportional to the exposed charge divided by the total capacitance described. As the electron is emitted from that surface, it will gain energy proportional to the electric field times the distance traversed. Thus, as the spacing is decreased between the ferroelectric surface and collector, a higher system capacitance results which decreases the electric field and therefore the electron energy.

The effect of changing the emitted electron energy by modifying the ferroelectric display system geometry in the transverse direction is as follows. To properly switch a ferroelectric emitter it is necessary to apply electrodes to both the front and rear surfaces. The rear electrode is typically solid. The front electrode is apertured to define the pixel and to allow the electrons to escape from the surface. As stated earlier, a polarization change is induced by applying an electric field of proper polarity. Once a polarization change has occurred, electron emission results from the ferroelectric surface.

The additional effect of the front electrode is to define the normal component of the electric field along an axis transverse to the direction of electron propagation. In the simplest form, this component of the electric field is proportional to the aperture radius. Thus for specific aperture sizes, the emitted electrons will possess a specific energy distribution.

In one embodiment, a combination of high voltage power supply and adjustments in geometry can further optimize the display system.

Other influences on the performance of the emission characteristics of the ferroelectric emitter exist. For instance, the electrodes must be of sufficient thickness so as to prevent severe joule heating and vaporization of the applied electrode material on the ferroelectric surfaces. To induce a change in the internal polarization and hence stimulate emission, one must traverse the $\vec{D}-\vec{E}$ curve (FIG. 2) from point A to B and from B to C, for example. Traversing the curve from point A to B requires application of a sufficiently large electric field so as to approach the proper threshold, $E_1$ which will induce a large polarization change (i.e. a change in $\vec{D}$) along segment B to C. This large and rapid polarization change is a necessary condition to assure emission.

To attain this threshold electric field, it is necessary to optimize the electrode geometry locally to the ferroelectric. For instance, if output electrode 23 is profiled to enhance the electric field in the ferroelectric crystal, significant emission can result at a decreased potential difference between input electrode 28 and output electrode 32 on the ferroelectric crystal.

Figure 2:
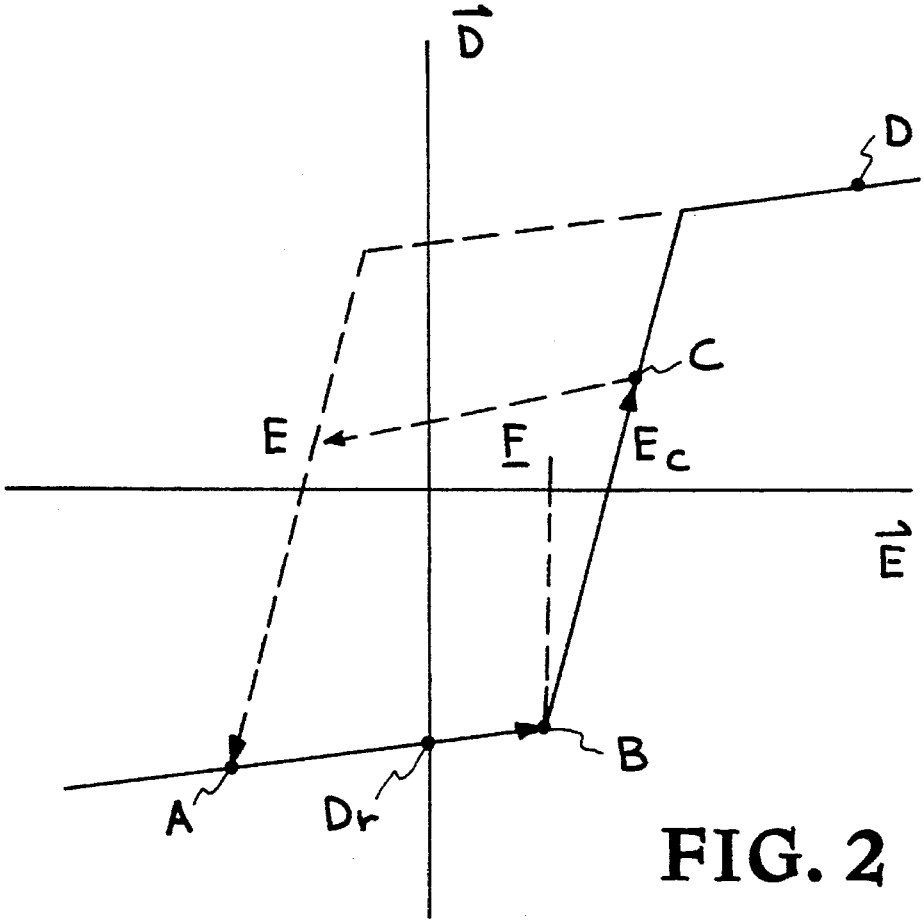
FIG. 2 shows the location of remnant electric displacement on the D–E graph.

It is also evident from FIG. 2 that a specific change in $\vec{D}$ (hence the change in polarization) occurs upon traversing from points A to D on the curve shown. Also, as is well known with these materials, the point at which the segment A to B crosses the $\vec{D}$ axis is called the remnant electric displacement or $D_r$. Without a means to control the value of $D_r$, variation can occur over time from pulse to pulse. Thus, the magnitude of the induced change in the polarization for a given change in the applied electric field can vary. This variation, if not intentional, will result in non-constant electron emission which results in a corresponding variation in the intensity of the associated pixel.

To ensure that the ferroelectric emitter material returns to a given remnant state requires use of a reset electric field. Although a well known technique in other devices, it has not as yet been applied to an emissive ferroelectric display system. For the particular requirement of a constant pixel intensity, the reset electric field would be made constant to ensure that the value of $D_r$ remains constant.

Although the optimum overall intensity of the display can be set and stabilized by influencing the electron emission, it is still necessary to adjust individual pixel intensities in real time to convey the proper visual information.

A particular phosphor will have the characteristic of an output luminosity based on incident electron energy and incident electron intensity. Further all phosphors, once excited, will decay in the intensity of the emitted light with a given time constant, after cessation of the electron beam. To excite a given phosphor to a given intensity requires that electrons of sufficient energy and intensity be deposited into the phosphor within a time short relative to the decay time constant. A ferroelectric emitter generates only a prompt burst of electrons and is therefore well suited to exploit this phosphor characteristic.

As mentioned above, the polarization change in the material, will depend on the value of $D_r$. As the value of this remnant field, and therefore the available polarization change, is dependent on the applied reset electric field, pixel intensity is controllable indirectly through this reset electric field.

By using the proper phosphor, it is also possible to control pixel intensity by repetitively pulsing the ferroelectric material so as to generate a pulse train of electron pulses which impinge onto the phosphor. In one method, the average electron current is controlled by delivering multiple pulses to the phosphor in a time short compared with the phosphor decay. Thus, intensity is controlled by the number of pulses incident and by phosphor persistence.

Similarly, if the emitter is pulsed more slowly, i.e., over a given time frame, the peak luminosity combined with the phosphor decay and pulse-rate will yield a given average pixel intensity. Thus, intensity is controlled by pulse repetition rate and phosphor persistence.

By modifying the grounded exit electrode or proper portions of that electrode so that its potential can be defined individually, each pixel intensity can be controlled by regulating the electron intensity (generally, i.e., energy will vary also) with that potential. Also, by the insertion of an additional grid between the grounded exit electrode and the phosphor and return current grid, a potential can be defined on that additional grid so as to control pixel intensity by regulating the electron intensity (generally, i.e., energy will vary also) with that potential.

It is also generally known that the intensity of the emitted electron beam from a ferroelectric emitter can be controlled with the rise-time of the applied pulse which induces the polarization change. Therefore, it is possible to control individual pixel intensity by modifying the applied pulse which is used to induce a polarization change in the material.

Figure 5:
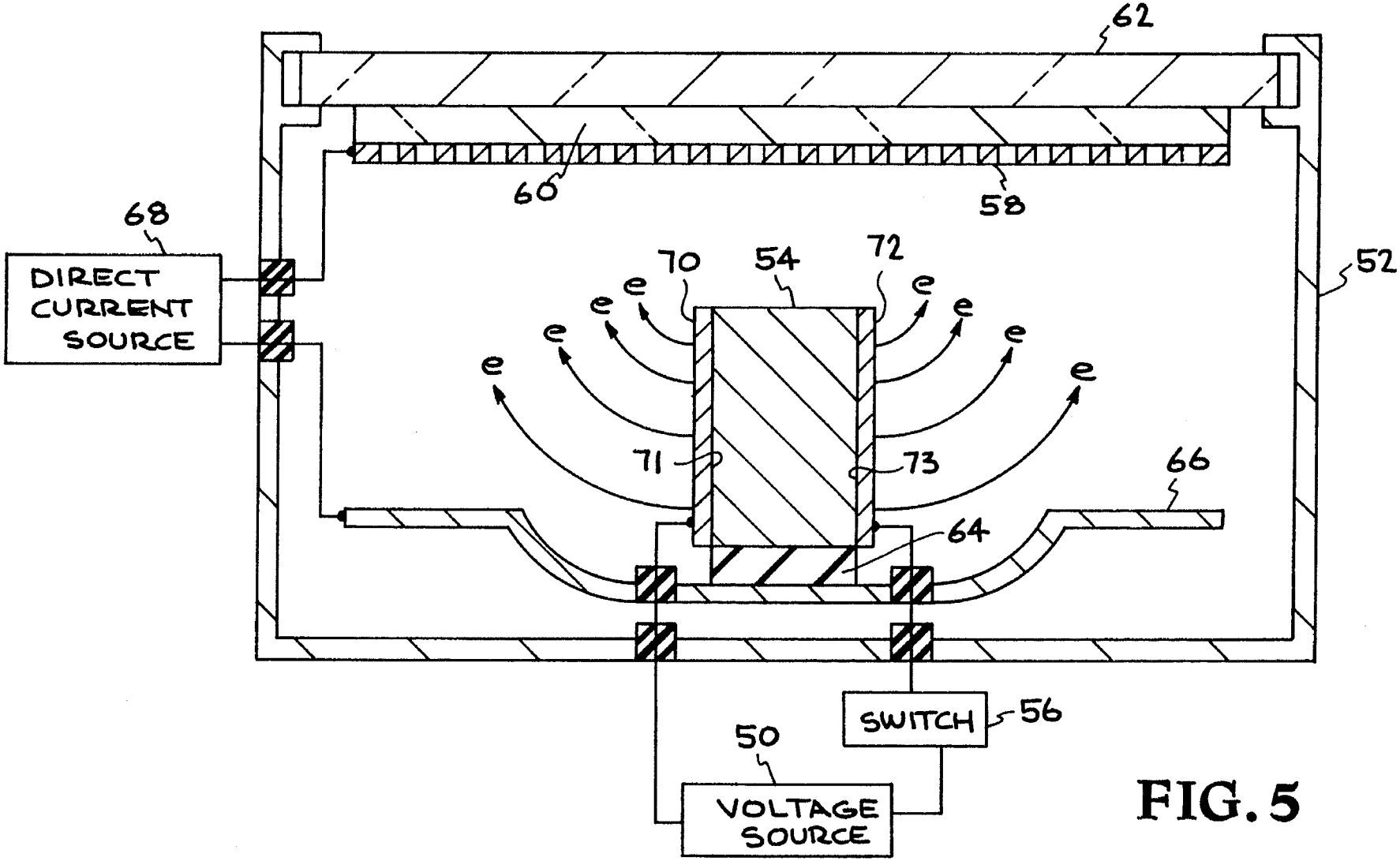
FIG. 5 shows a two sided ferroelectric display.

A two sided ferroelectric display, as shown in FIG. 5, comprises a voltage source 50 (providing alternating current), an evacuated enclosure 52, a ferroelectric emitter 54, means 56 for switching the voltage source 50 to the ferroelectric emitter 54, metal grid 58, phosphor coated screen 60 and glass portion 62. An insulator 64 is placed between ferroelectric emitter 54 and negatively charged surface 66. A direct current source 68 is connected between negatively charged surface 66 and metal grid 58. Electrodes 70 and 72 are electrically connected to a first side 71 and a second side 73 respectively of the ferroelectric emitter 54. By alternating the polarity of the electrodes, the ferroelectric emitter will emit from one side and then from the other side. The negatively charged surface will direct the electrons up to the phosphor coated screen.

Figure 6:
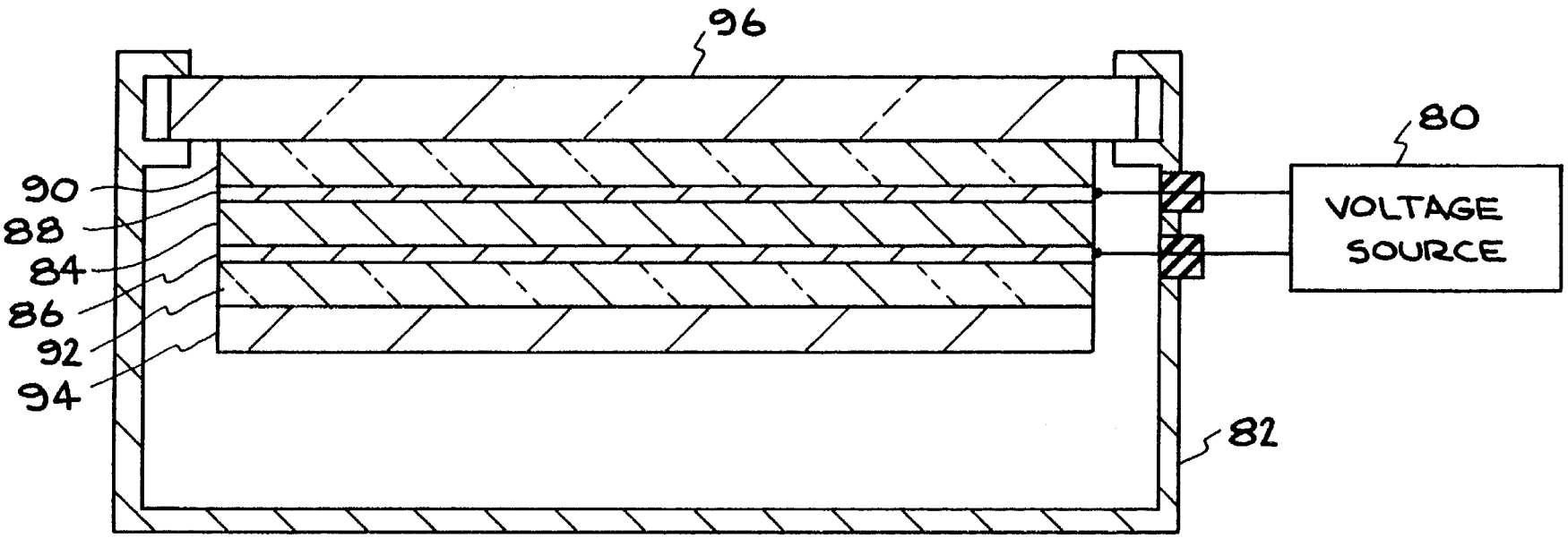
FIG. 6 shows a two sided ferroelectric display.

FIG. 6 shows another two sided ferroelectric emitter comprising a voltage source 80, an evacuated enclosure 82, ferroelectric emitter 84 having metal electrodes 86 and 88, a first phosphor coated screen 90, a second phosphor coated screen 92, a metal reflector 94 and a glass portion 96. The ferroelectric emits from both sides and excites light emission in the two phosphor layers. By making the electrodes and ferroelectric transparent, the metal reflector can reflect the light from the bottom layer up through the phosphor and out the top, doubling the light output and eliminating the need for a reset of the ferroelectric.

Changes and modifications in the specifically described embodiments can be carried out without departing from the scope of the invention, which is intended to be limited by the scope of the appended claims.

We claim:

1. An emissive flat panel ferroelectric display system, comprising:

an evacuated enclosure;

at least one ferroelectric emitter within said evacuated enclosure;

means for applying a pulsed electric field to said ferroelectric emitter; and a phosphor coated screen within said evacuated enclosure, said screen positioned to receive electrons emitted from said at least one ferroelectric emitter.

2. The system of claim 1, wherein said means for applying a pulsed electric field to said ferroelectric emitter comprises at least one voltage source and means for switching said at least one voltage source to said at least one ferroelectric emitter.

3. The system of claim 2, wherein said ferroelectric emitter comprises: a ferroelectric material having an input face and an output face; an input electrode electrically connected to said input face; and an output electrode electrically connected to said output face.

4. The system of claim 3, further comprising at least one voltage storage device electrically connected between said at least one voltage source and said switching means.

5. The system of claim 4, wherein said at least one voltage storage device is selected from a group consisting of at least one capacitor and at least one inductor.

6. The system of claim 3, wherein said output electrode is electrically common to said at least one voltage source.

7. The system of claim 3, wherein said output electrode is electrically connected to ground.

8. The system of claim 3, further comprising a return current means within said evacuated enclosure, said return current means comprising an electrically conductive grid located between said output electrode and said phosphor screen, wherein said grid is electrically connected to said output electrode.

9. The system of claim 1, further comprising a collimator positioned between said at least one ferroelectric emitter and said phosphor coated screen to receive and collimate electrons emitted from said at least one ferroelectric emitter.

10. The system of claim 1, wherein said at least one ferroelectric emitter comprises a ferroelectric emitter array.

11. The system of claim 1, wherein said at least one ferroelectric emitter comprises at least one two-dimensional row/column ferroelectric emitter array.

12. The system of claim 4, wherein said at least one voltage storage device is electrically isolated from said at least one voltage source by a first resistor, and said at least one voltage storage device is electrically isolated from said switching means by a second resistor.

13. The system of claim 1, wherein said switching means comprise at least one row/column addressable switch.

14. The system of claim 8, wherein said return current means further comprises a high voltage power supply electrically connected between said grid and said output electrode, wherein said return current means controls the electron energy of said electrons emitted from said at least one ferroelectric emitter.

15. The system of claim 1, wherein said phosphor coated screen comprises a two-dimensional matrix of red-green-blue phosphors for color display.

16. The system of claim 1, wherein said phosphor coated screen comprises a continuous layer of a single phosphor color for single color display.

17. The system of claim 1, wherein a distance between said at least one ferroelectric emitter and said phosphor coated screen is varied to control pixel intensity of said phosphor coated screen.

18. The system of claim 3, wherein aperture size of said output electrode is varied to control pixel intensity of said phosphor coated screen.

19. The system of claim 3, wherein said phosphor coated screen has pixel intensity controlled by a combination of varying the distance between said at least one ferroelectric emitter and said phosphor coated screen and varying aperture size of said output electrode.

20. The system of claim 14, wherein the distance between said ferroelectric emitter and said phosphor coated screen is varied in combination with the use of said high voltage power supply to control pixel intensity of said phosphor coated screen.

21. The system of claim 8, wherein said grid has a voltage set relative to a voltage set on said output electrode to control electron energy of said electrons emitted from said at least one ferroelectric emitter.

22. The system of claim 1, wherein said at least one ferroelectric emitter comprises a constant reset electric field, wherein said at least one ferroelectric emitter has a remnant state made constant with said constant reset electric field.

23. The system of claim 1, wherein said switching means controls pixel intensity of said phosphor coated screen by inducing repetitive electron emission from said at least one ferroelectric emitter.

24. The system of claim 1, wherein said switching means controls pixel intensity of said phosphor coated screen by switching a pulse of variable rise time to induce a correspondingly variable peak amplitude electron beam intensity from said ferroelectric emitter.

25. The system of claim 1, wherein said at least one ferroelectric emitter comprises a variable reset electric field, wherein said at least one ferroelectric emitter has a remnant state made variable with said variable reset electric field.

26. The system of claim 1, further comprising:

a metal grid electrically connected to said phosphor coated screen between said at least one ferroelectric emitter and said phosphor coated screen;

a glass portion fixedly connected to said phosphor coated screen on a side opposite from said metal grid;

an insulator having a first side and a second side, said first side fixedly connected to said at least one ferroelectric emitter;

a negatively charged surface fixedly connected to said second side of said insulator;

a direct current source electrically connected between said metal grid and said negatively charged surface; and a first electrode electrically connected to a first side of said at least one ferroelectric emitter and a second electrode electrically connected to a second side of said at least one ferroelectric emitter;

wherein said voltage source comprises a source of alternating current, wherein said at least one ferroelectric emitter will alternately emit electrons from said first side of said at least one ferroelectric emitter and said second side of said at least one ferroelectric emitter, wherein said negatively charged surface will direct the electrons to said phosphor coated screen.

27. The system of claim 1, further comprising:

a second phosphor coated screen positioned to receive electrons emitted from said at least one ferroelectric emitter;

a metal reflector positioned on a side of said second phosphor coated screen opposite from said at least one ferroelectric emitter;

a glass portion fixedly connected to said phosphor coated screen; and a first electrode electrically connected to a first side of said at least one ferroelectric emitter and a second electrode electrically connected to a second side of said at least one ferroelectric emitter;

wherein said at least one ferroelectric emitter comprises a first electron emitting side and a second electron emitting side.

28. The system of claim 3, wherein said output electrode is profiled to enhance an electric field in said ferroelectric material.

* * * * *